US007789636B2

(12) United States Patent
Liebl et al.

(10) Patent No.: US 7,789,636 B2
(45) Date of Patent: Sep. 7, 2010

(54) TURBOMACHINE, PARTICULARLY EXHAUST GAS TURBOCHARGER

(75) Inventors: Sven Liebl, Kaiserslautern (DE); Bruno Ferling, Beindersheim (DE); Dirk Frankenstein, Worms (DE)

(73) Assignee: BorgWarner, Inc., Auburn Hills, MI (US)

( * ) Notice: Subject to any disclaimer, the term of this patent is extended or adjusted under 35 U.S.C. 154(b) by 739 days.

(21) Appl. No.: 11/347,606

(22) Filed: Feb. 3, 2006

(65) Prior Publication Data

US 2006/0177319 A1 Aug. 10, 2006

(30) Foreign Application Priority Data

Feb. 7, 2005 (EP) ..... 05002505

(51) Int. Cl.
*F04B 17/00* (2006.01)

(52) U.S. Cl. ..... 417/407; 277/391

(58) Field of Classification Search ..... 417/407; 277/391, 390, 392, 393
See application file for complete search history.

(56) References Cited

U.S. PATENT DOCUMENTS

| | | | | |
|---|---|---|---|---|
| 1,364,441 | A * | 1/1921 | Kraft | 251/149.1 |
| 2,494,841 | A * | 1/1950 | Svenson | 60/461 |
| 3,122,375 | A | 2/1964 | Greenwald | |
| 3,160,418 | A * | 12/1964 | Barske | 277/384 |
| 3,258,199 | A * | 6/1966 | Anderson | 415/175 |
| 3,969,804 | A * | 7/1976 | MacInnes et al. | 29/888.025 |
| 4,136,887 | A * | 1/1979 | Wentworth, Jr. | 277/374 |
| 4,281,985 | A * | 8/1981 | Mee et al. | 432/205 |
| 4,453,722 | A | 6/1984 | Swanson et al. | |
| 5,058,905 | A * | 10/1991 | Nosowicz et al. | 277/365 |
| 5,421,594 | A * | 6/1995 | Becerra | 277/608 |
| 5,628,520 | A * | 5/1997 | Ueda et al. | 277/654 |
| 2002/0125648 | A1 | 9/2002 | Vedsted et al. | |
| 2003/0205047 | A1 * | 11/2003 | Allmang et al. | 60/602 |
| 2004/0120835 | A1 | 6/2004 | O'Hara | |

FOREIGN PATENT DOCUMENTS

| | | |
|---|---|---|
| DE | 297 04 914 U1 | 8/1997 |
| DE | 100 28 161 C2 | 12/2001 |
| DE | 102 97 203 T5 | 8/2004 |
| EP | 1 496 294 A1 | 1/2005 |

* cited by examiner

*Primary Examiner*—Devon C Kramer
*Assistant Examiner*—Dnyanesh Kasture
(74) *Attorney, Agent, or Firm*—Warn Partners, P.C.

(57) ABSTRACT

A turbomachine, particularly an exhaust gas turbocharger, comprising a compressor wheel arranged in a compressor housing, a turbine wheel arranged in a turbine housing, and a rotor shaft which is guided in a bearing casing and which has fastened thereto the compressor wheel on the one hand and the turbine wheel on the other hand, a rotor-shaft seal being arranged between a turbine-sided end portion of the bearing casing and the rotor shaft.

10 Claims, 2 Drawing Sheets

TURBOMACHINE, PARTICULARLY EXHAUST GAS TURBOCHARGER

CROSS-REFERENCE TO RELATED APPLICATIONS

This application claims priority to European Patent Application No. 05002505.5 filed Feb. 7, 2005.

FIELD OF THE INVENTION

The present invention relates to a turbomachine, particularly an exhaust gas turbocharger.

BACKGROUND OF THE INVENTION

Such a turbomachine in the form of a turbocharger is known from US 2004/0120835 A1.

U.S. Pat. No. 4,453,722 discloses a carbon seal which is pressed by a bellows against a seal plate, and a back-up seal is additionally provided which consists of a piston ring intended to maintain its bias even if the bellows fails.

A further turbomachine in the form of a turbocharger is known from DE 100 28 161 C2 and DE 102 97 203 T5.

The sealing which can be seen there at the turbine side between rotor shaft and bearing casing is accomplished by means of a labyrinth seal.

Leakage is thus possible both in the direction of the turbine wheel and in the direction of the bearing casing.

In comparison with this prior art, it is the object of the present invention to provide a turbomachine which allows a better sealing of chambers acted upon by media, such as liquids and/or gases of different pressures.

SUMMARY OF THE INVENTION

Accordingly, the present invention relates to a turbomachine, particularly in the form of an exhaust gas turbocharger, e.g. for automotive vehicles, comprising a rotor-shaft sealing system provided at the turbine side, which may preferably be configured in the form of a gas-lubricated slide ring seal. Said rotor-shaft sealing system permits the sealing of chambers which are acted upon by media (liquids and/or gases) which are subjected to different pressures, with a rotating shaft, which in the case of a turbocharger is a rotor shaft, being guided through a housing wall. The turbomachine of the invention or the rotor-shaft sealing system of the invention is suited for high temperatures (up to 900° C.) and extremely high speeds (up to 300,000 $m^{-1}$) and circumferential speeds up to 550 m/s.

Furthermore, a rotating counter ring (with profile) is fixed to the rotor shaft, which can e.g. be accomplished by shrinking, screwing or pressing. Furthermore, a stationary slide ring with resilient means, preferably in the form of a metal diaphragm bellows, is screwed via a screw-in sleeve in the housing. During operation of the turbocharger, the counter ring together with the slide ring represents the dynamic seal and the metal diaphragm bellows with the graphite ring constitutes the static seal.

The metal diaphragm bellows represents a biasing means which establishes a resilient contact. Preferably, it is here possible to weld the individual resilient elements of the bellows together and then to the welding lips provided for this purpose on an adapter plate of the screw-in sleeve. Hence, it is advantageously possible to pre-mount said member of the whole sealing means already as a cartridge. During mounting of the cartridge a bias is observed in the metal diaphragm bellows, so that axial play and possible wear of the slide surfaces can advantageously be minimized.

When the turbocharger is at a standstill, the counter ring and the slide ring form a static seal between rotor shaft and bearing casing.

During operation of the turbocharger the rotation of the counter ring builds up pressure due to the axial profile thereof in the contact surface with the slide ring, resulting in the formation of a small axial gap.

During operation this creates a contactless, gas-lubricated dynamic slide ring seal which does not cause any mechanical frictional losses.

The profile of the counter ring has been chosen such that leakage (gap flow) from the turbine wheel into the interior of the bearing casing is supported.

The present invention as a further embodiment also includes an inventive rotor-shaft sealing means as an independently tradable member.

The present invention is a preferred embodiment also includes a method for producing a turbomachine with a rotor-shaft sealing means, the method including the following steps:

inserting the graphite ring into the bearing casing;

mounting the counter ring on a mounting mandrel and insertion into the bearing casing;

screwing the cartridge with slide ring and resilient means with the help of a tool, which grips into bores provided therefor in the screw-in sleeve, into the bearing casing, and resulting pressing of the graphite ring;

sliding a heat shield onto the rotor shaft; and introducing the rotor shaft into the bearing casing, the counter ring being pressed with the help of the mounting mandrel onto the rotor shaft.

BRIEF DESCRIPTION OF THE DRAWINGS

Further details, advantages and features of the present invention become apparent from the following description of an embodiment with reference to the enclosed drawing, in which.

DETAILED DESCRIPTION OF THE PREFERRED EMBODIMENTS

Figure 1:
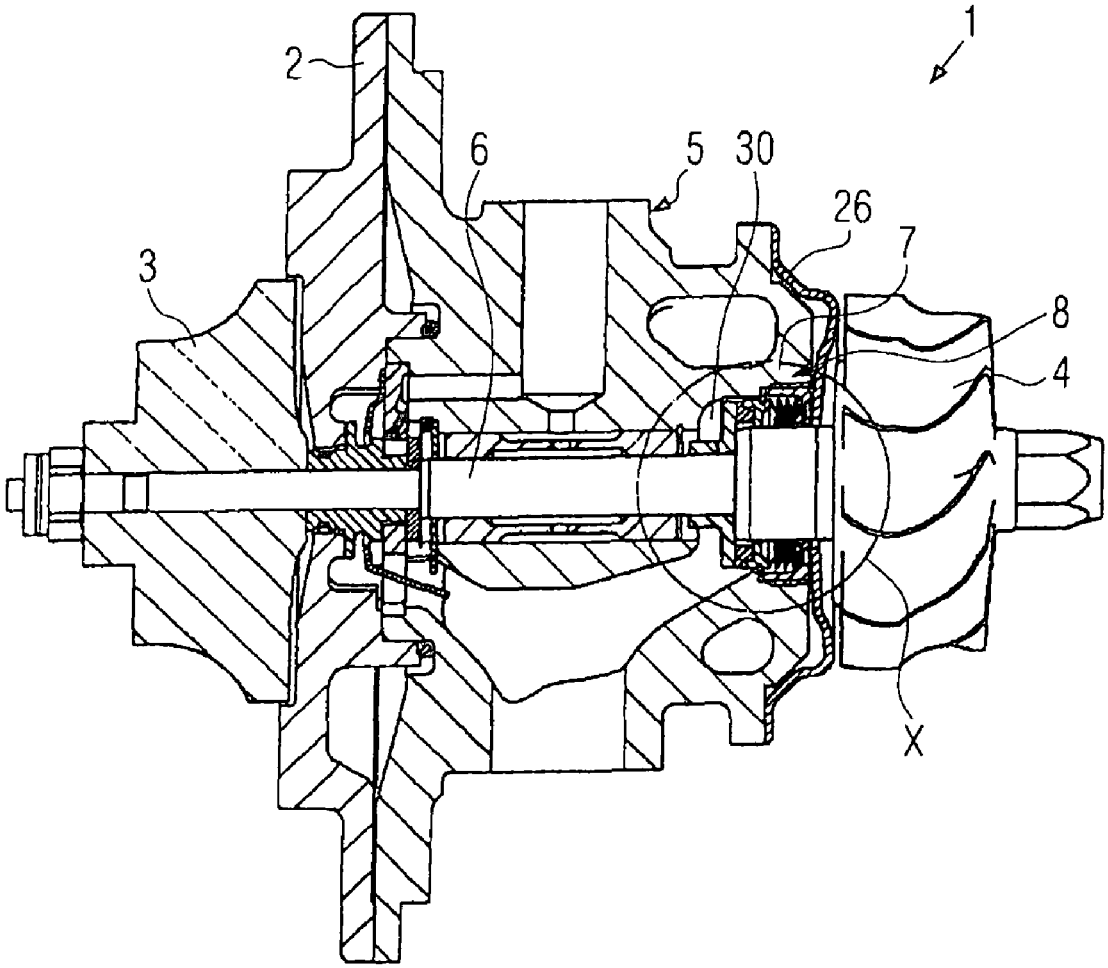
FIG. 1 shows a longitudinal section through a turbomachine of the invention in the form of a turbocharger.

FIG. 1 shows a turbomachine 1 of the invention, which in this example is configured as an exhaust gas turbocharger.

Apart from the following details of a rotor-shaft sealing means 8 according to the invention, this exhaust gas turbocharger contains, as a matter of course, all of the standard components which, however, are partly not shown for simplifying the illustration in FIG. 1 because these are not needed for explaining the present invention.

However, FIG. 1 shows the rear wall 2 of a compressor housing (not shown) and a compressor wheel 3 arranged in said compressor housing.

Furthermore, a turbine wheel (rotor) 4 is shown, which is arranged in a turbine housing (not shown).

The compressor wheel 3 and the turbine wheel 4 are mounted on a rotor shaft 6 at opposite ends thereof, as follows in detail from FIG. 1.

The rotor shaft 6 is guided via a suitable bearing arrangement in a bearing casing 5.

The bearing casing 5 comprises an end portion 7 provided at the turbine side, which is arranged in the vicinity of the turbine wheel 4 and which is protected by a heat shield 26 from excessive heating.

The end portion 7 at the turbine side comprises a receiving chamber 30 for a rotor-shaft sealing means 8 which is marked in FIG. 1 with detail X and which will be explained in detail in the following with reference to the enlarged illustration of FIG. 2.

The rotor-shaft sealing means 8 is constructed as a gas-lubricated slide-ring sealing means which comprises a static sealing arrangement and a dynamic sealing arrangement.

In detail, a counter ring 11 is provided which comprises a fixing section 12 which can be fixed (shrunk, screwed or pressed) onto a first rotor-shaft area 9.

Furthermore, the counter ring 11 comprises an annular collar 13 which is preferably arranged at a right angle to the fixing section 12 and which partly axially rests on a transition area 31 of the rotor shaft 9 which leads to a second rotor shaft area 10 having a larger diameter than the first rotor shaft area 9.

The rotor-shaft sealing means 8 further comprises a slide ring 14 which is screwed with a biasing means, preferably in the form of the illustrated metal diaphragm bellows 19, view a screw-in sleeve 20 with external thread 27 in the bearing casing 5 or in the end section 7 of the bearing casing 5.

As illustrated, the slide ring 14 comprises a main body 16 and a nose 15 which extends radially outwards from the main body 16. This arrangement provides a contact surface which faces the collar 13 of the counter ring 11 and gets into contact with said collar, as illustrated in FIG. 2, in the mounted state.

Figure 2:
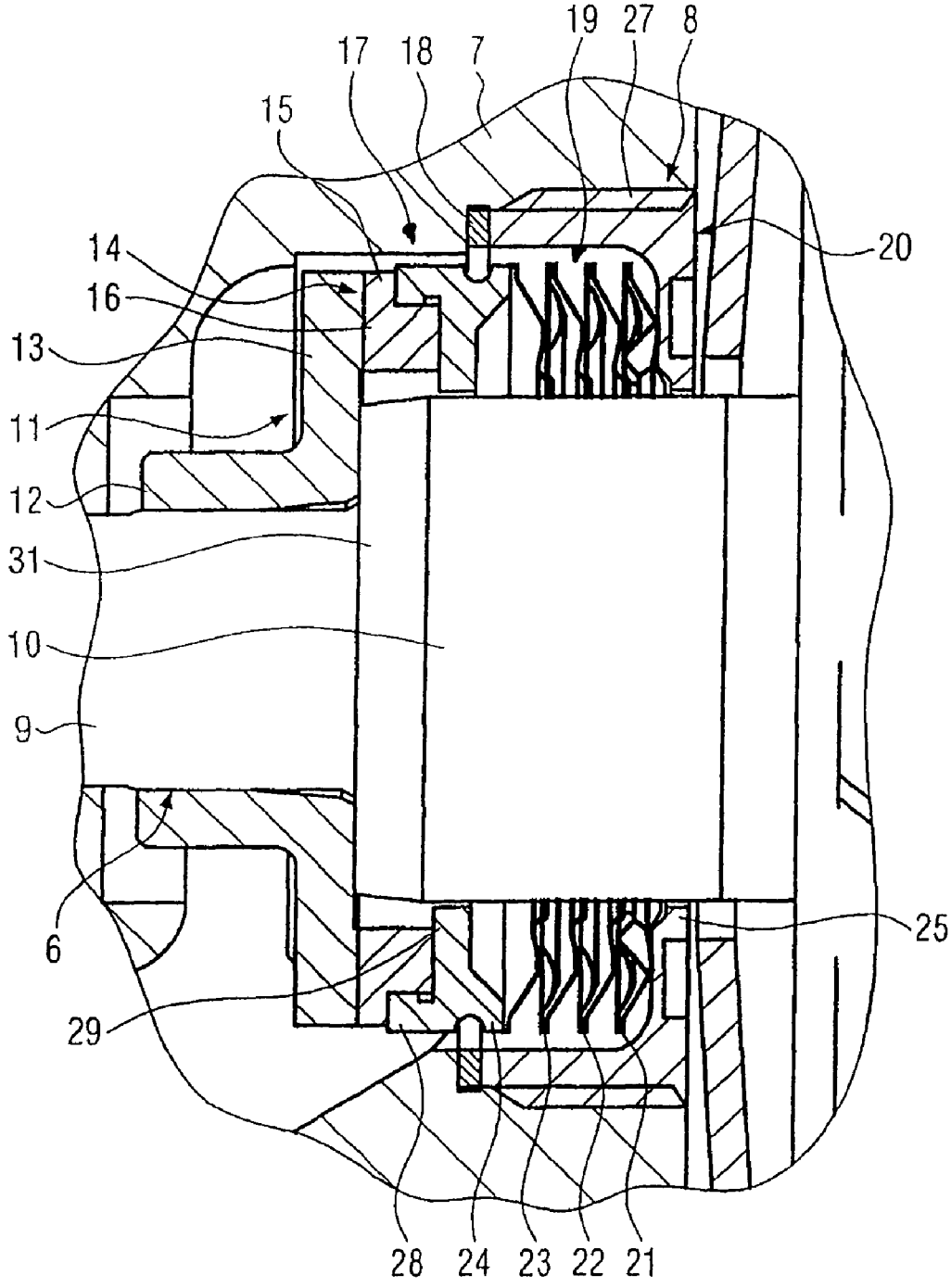
FIG. 2 shows detail X in FIG. 1 on an enlarged scale for explaining the constructional details of the inventive rotor-shaft sealing means.

Furthermore, FIG. 2 illustrates a graphite ring 18 which is clamped in the casing 5 in the screwed-in state of the screw-in sleeve 20.

An adapter plate 17 which is firmly connected to the slide ring 14 is arranged between the slide ring 14 and the arrangement consisting of screw-in sleeve 20 and metal diaphragm bellows 19.

At the opposite end, the adapter plate 17 comprises a welding lip 24 which has welded thereto a resilient member 23 of a resilient arrangement consisting of the resilient members 21, 22 and 23 of the metal diaphragm bellows 19.

The resilient member 21, in turn, is welded to a welding lip 25 of the screw-in sleeve 20.

As has already been explained above, the individual resilient members 21 to 23 of the bellows 19 which are welded together, the adapter plate 17 and the screw-in sleeve 20, as well as the slide ring 14 constitute a pre-mountable cartridge. Upon installation of said cartridge a bias of the slide ring 14 is produced by the metal diaphragm bellows 19, so that the axial play and possible wear of the slide surfaces can be minimized. Finally, as follows from FIG. 2, the adapter plate 17 comprises an annular body 29 which is arranged around the rotor shaft section 10 of the rotor shaft 6 and which is provided at its radially outwardly oriented end with the welding lip 24 and the connecting section 28.

As illustrated in FIG. 2, the connecting section 28 rests on both the nose 15 and the main body 16 of the slide ring 14, whereas the ring body 29 rests on the main body 16 of the slide ring 14. As for further details of the arrangements of the above-described members, explicit reference is herewith made to the graphic disclosure in FIG. 2.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A turbomachine, comprising:

a compressor wheel arranged in a compressor housing;

a turbine wheel arranged in a turbine housing; and a rotor shaft which is guided in a bearing casing and which has fastened thereto the compressor wheel on the one hand and the turbine wheel on the other hand, a rotor-shaft seal being arranged between a turbine-sided end portion of the bearing casing and the rotor shaft and comprising a counter ring, which is fixed to the rotor shaft, said counter ring having a fixing section fixed to a smaller diameter area of the rotor shaft and an annular collar integrally formed as one piece with the fixing section and arranged substantially at a right angle to the fixing section to at least partly axially rest against a transition area of the rotor shaft leading to a larger diameter of the rotor shaft; and a biasing arrangement having one diaphragm bellows, wherein said one diaphragm bellows is welded to a sleeve body of a screw in sleeve at one end of said one diaphragm bellows and the opposite end of said one diaphragm bellows is welded to a ring body of an adapter plate, wherein said adapter plate is in bias contact with a slide ring such that axial play and wear of slide surfaces of said slide ring are minimized, wherein said slide ring is connected to a connection area of said adapter plate and is fixed by means of a screw-in sleeve with interposition of the biasing arrangement in the bearing casing.

2. The turbomachine according to claim 1, wherein the rotor-shaft seal is configured as a gas-lubricated slide-ring seal.

3. The turbomachine according to claim 2, wherein the slide-ring seal comprises a static sealing arrangement and a dynamic seal unit.

4. The turbomachine according to claim 3, wherein the dynamic seal unit produces the dynamic sealing action through the slide ring with the counter ring fixed to the rotor shaft.

5. The turbomachine according to claim 1 wherein the two or more diaphragm bellows are metal.

6. The turbomachine according to claim 5, wherein the two or more diaphragm bellows, the screw-in sleeve and an adapter plate are configured as a pre-mounted cartridge.

7. The turbomachine according to claim 6, wherein the two or more diaphragm bellows comprise resilient members which are welded to one another and which are welded to welding lips of the adapter plate and of the screw-in sleeve, respectively, for forming the cartridge.

8. The turbomachine according to claim 1, further comprising a graphite ring which is inserted into the bearing casing and which is clamped by way of the screw-in sleeve in contact with the graphite ring.

9. The turbomachine according to claim 1, wherein a heat shield is arranged between the turbine-sided end portion and the turbine wheel.

10. A rotor-shaft seal between a turbine-sided end portion of a bearing casing and a rotor shaft of a turbomachine, which comprises a compressor wheel arranged in a compressor housing and a turbine wheel arranged in a turbine housing, comprising:

a counter ring fixed to the rotor shaft, said counter ring having a fixing section fixed to a smaller diameter area of the rotor shaft and an annular collar integrally formed as one piece with the fixing section and arranged substantially at a right angle to the fixing section to at least partly axially rest against a transition area of the rotor shaft leading to a larger diameter area of the rotor shaft; and a biasing arrangement having one diaphragm bellows, wherein said one diaphragm bellows is welded to a sleeve body of a screw in sleeve at one end of said one diaphragm bellows and the opposite end of said one diaphragm bellows is welded to a ring body of the adapter plate, wherein said adapter plate is in bias contact with a slide ring positioned between said adapter plate and said counter ring such that axial play and wear of slide surfaces on said slide ring are minimized wherein said slide ring is connected to a connection area of said adapter plate and is fixed by means of a screw-in sleeve with interposition of the biasing arrangement in the bearing casing.

* * * * *